US006713958B2

(12) United States Patent
Oniki

(10) Patent No.: US 6,713,958 B2
(45) Date of Patent: Mar. 30, 2004

(54) ALTERNATING CURRENT DRIVEN TYPE PLASMA DISPLAY DEVICE

(75) Inventor: Kazunao Oniki, Tokyo (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/757,627

(22) Filed: Jan. 11, 2001

(65) Prior Publication Data

US 2001/0015621 A1 Aug. 23, 2001

(30) Foreign Application Priority Data

Jan. 12, 2000 (JP) ..... P2000-006285
Mar. 27, 2000 (JP) ..... P2000-086673
Jun. 20, 2000 (JP) ..... P2000-184415
Jul. 24, 2000 (JP) ..... P2000-222006

(51) Int. Cl.[7] ..... H01J 17/49; H01J 17/20
(52) U.S. Cl. ..... 313/582; 313/576; 313/643
(58) Field of Search ..... 313/582, 568, 313/572, 575, 576, 637, 643

(56) References Cited

U.S. PATENT DOCUMENTS 5,672,208 A * 9/1997 Morita ..... 118/723 E
5,770,921 A * 6/1998 Aoki et al. ..... 313/572
5,903,381 A 5/1999 Watanabe et al.
6,057,643 A * 5/2000 Kurai ..... 313/582
6,097,150 A 8/2000 Watanabe
6,107,739 A * 8/2000 Ha ..... 313/582
6,194,831 B1 * 2/2001 Park et al. ..... 313/581
6,265,825 B1 7/2001 Asano
6,297,582 B1 * 10/2001 Hirota et al. ..... 313/110
6,414,445 B2 * 7/2002 Van Heusden et al. ..... 313/576

FOREIGN PATENT DOCUMENTS

EP 0 779 643 6/1997
EP 1221711 A2 * 7/2002 ..... H01J/9/02
JP 05-266804 10/1993
JP 10125237 5/1998
JP 10-334811 12/1998
JP 11153969 6/1999
JP 11-250811 9/1999
JP 2001-005425 1/2001
JP 2001-236884 8/2001

* cited by examiner

*Primary Examiner*—Robert Beatty
(74) *Attorney, Agent, or Firm*—Rader, Fishman & Grauer PLLC; Ronald P. Kananen

(57) ABSTRACT

An alternating current driven type plasma display device includes a plurality of sustain electrodes having a spacing less than $5\times10^{-5}$ m and a discharge gas in a discharge space where discharge takes place. The discharge gas consists of xenon gas alone having a pressure greater than or equal to $1.0\times10^{4}$ Pa and less than or equal to $3.0\times10^{4}$ Pa or the discharge gas consists of krypton gas alone having a pressure less than or equal to $6.6\times10^{4}$ Pa.

4 Claims, 11 Drawing Sheets

(EXAMPLE 2)

RELATIONSHIP BETWEEN DISCHARGE GAP AND BRIGHTNESS (EXAMPLE 3)

(EXAMPLE 4)

RELATIONSHIP BETWEEN Kr GAS CONCENTRATION AND BRIGHTNESS (EXAMPLE 5)

CHROMATICITY DIAGRAM

ALTERNATING CURRENT DRIVEN TYPE PLASMA DISPLAY DEVICE

BACKGROUND OF THE INVENTION AND RELATED ART STATEMENT

The present invention relates to an alternating current driven type plasma display device having a characteristic feature in a discharge gas sealed in a discharge space where discharge takes place.

As an image display device that can be substituted for a currently mainstream cathode ray tube (CRT), flat-screen (flat-panel) display devices are studied in various ways. Such fat-panel display devices include a liquid crystal display (LCD), an electroluminescence display (ELD) and a plasma display device (PDP). Of these, the plasma display device has advantages that it is relatively easy to produce a larger screen and attain a wider viewing angle, that it has excellent durability against environmental factors such as temperatures, magnetism, vibrations, etc., and that it has a long lifetime. The plasma display device is therefore expected to be applicable not only to a home-use wall-hung television set but also to a large-sized public information terminal.

In the plasma display device, a voltage is applied to discharge cells formed by charging discharge spaces with a discharge gas composed of a rare gas, and a fluorescence layer in each discharge cell is excited with ultraviolet ray generated by glow discharge in the discharge gas, to give light emission. That is, each discharge cell is driven according to a principle similar to that of a fluorescent lamp, and generally, the discharge cells are put together on the order of hundreds of thousands to constitute a display screen. The plasma display device is largely classified into a direct current driven type (DC type) and an alternating current driven type (AC type) according to methods of applying a voltage to the discharge cells, and each type has advantages and disadvantages. The AC type plasma display device is suitable for attaining a higher fineness, since separation walls which work to separate the discharge cells within a display screen can be formed, for example, in the form of stripes. Further, it has an advantage that electrode is less worn out and has a long lifetime, since the surface of the electrode for discharge is covered with a dielectric material.

FIG. 1 shows a schematic exploded perspective view of typical constitution of the AC type plasma display device. This AC type plasma display device comes under a so-called tri-electrode type, and discharging takes place mainly between a pair of sustain electrodes 12. In the AC type plasma display device shown in FIG. 1, a first panel 10 corresponding to a front panel and a second panel 20 corresponding to a rear panel are bonded to each other in their circumferential portions. Light emission from fluorescence layers 25 on the second panel 20 is viewed, for example, through the first panel 10.

The first panel 10 comprises a transparent first substrate 11; pairs of sustain electrodes 12 composed of a transparent electrically conductive material and formed on the first substrate 11 in the form of stripes; bus electrodes 13 composed of a material having a lower electric resistivity than the sustain electrode 12 and formed on the sustain electrodes 12 for decreasing the impedance of the sustain electrode 12; a dielectric material layer 14 composed of a dielectric material and formed on the sustain electrodes 12, the bus electrodes 13 and the first substrate 11; and a protective layer 15 composed of MgO and formed on the dielectric material layer 14.

The second panel 20 comprises a second substrate 21; address electrodes (also called data electrodes) 22 formed on the second substrate 21 in the form of stripes; a dielectric film 23 formed on the second substrate 21 and on the address electrodes 22; insulating separation walls 24 which are formed in regions on the dielectric film 23 and between neighboring address electrodes 22 and which extend in parallel with the address electrodes 22; and fluorescence layers 25 which are formed on, and extend from, upper surfaces of the dielectric film 23 and which are also formed on side walls of the separation walls 24. When the AC type plasma display device is used for display in colors, each fluorescence layer 25 is constituted of a red fluorescence layer 25R, a green fluorescence layer 25G and a blue fluorescence layer 25B, and the fluorescence layers 25R, 25G and 25B of these colors are formed in a predetermined order. FIG. 1 is an exploded perspective view, and in an actual embodiment, top portions of the separation walls 24 on the second panel side are in contact with the protective layer 15 on the first panel side. A region where a pair of the sustain electrodes 12 and the address electrode 22 positioned between two of the separation walls 25 overlap corresponds to a discharge cell. A discharge gas is sealed in each discharge space surrounded by neighboring two separation walls 24, the fluorescence layer 25 and the protective layer 15. The first panel 10 and the second panel 20 are bonded to each other with a frit glass in their circumferential portions.

The extending direction of a projection image of the sustain electrode 12 and the extending direction of a projection image of the address electrode 22 cross each other at right angles, and a region where a pair of the sustain electrodes 12 and one combination of the fluorescence layers 25R, 25G and 25B for emitting light in three primary colors overlap corresponds to one pixel. Since glow discharge is caused between a pair of the sustain electrodes 12, the AC type plasma display device of the above type is called "surface discharge type". For example, a pulse voltage lower than the discharge initiating voltage of the discharge cell is applied to the address electrode 22 immediately before the application of a voltage between the pair of the sustain electrodes 12. As a result, a wall charge is accumulated in the discharge cell (selection of a discharge cell for display), and the apparent discharge initiating voltage decreases. Then, the discharge initiated between the pair of the sustain electrodes 12 can be sustained at a voltage lower than the discharge initiating voltage. In the discharge cell, the fluorescence layer excited by irradiation with vacuum ultraviolet ray generated by glow discharge in the discharge gas emits light in a color characteristic of a fluorescence material. Vacuum ultraviolet ray having a wavelength according to a kind of the charged discharge gas is generated.

Generally, the discharge gas charged in the discharge space is composed of a mixture prepared by mixing approximately 4% by volume of a xenon gas with an inert gas such as neon (Ne) gas, helium (He) gas or argon (Ar) gas. The distance between a pair of the sustain electrodes 12 is approximately 100 $\mu$m, specifically 70 $\mu$m to 120 $\mu$m.

Currently commercialized AC type plasma display devices have a problem that the brightness thereof is low. For example, a 42-inch AC type plasma display device has a brightness of approximately 500 cd/m$^2$ at the highest. For practically commercializing an AC type plasma display device, further, it is required, for example, to attach a sheet or a film as a shield against electromagnetic waves or external light to the outer surface of the first panel 10, and the AC type plasma display device comes to be dark on an actual screen.

When the discharge gas charged in the discharge space is pressure-increased for increasing the brightness, there is caused a problem that the discharge voltage increases, that the discharge comes to be unstable, or that the discharge is non-uniform. When the discharge gas charged in the discharge space is pressure-increased, the discharge gas exerts a force on the first panel 10 and the second panel 20 to separate them from each other. As a result, the reliability of the bonding of the first panel 10 and the second panel 20 with the frit glass may decrease. Further, when the discharge gas is expanded due to a temperature added to the AC type plasma display device, the discharge gas possibly leaks through the junction portion between the first panel 10 and the second panel 20. In a conventional AC type plasma display device, therefore, it is therefore difficult to increase the pressure of the discharge gas sealed in the discharge space for increasing the brightness.

In the AC type plasma display device, further, there is the law of Paschen between a product (d·p) of a distance (d) between a pair of the sustain electrodes 12 and the total pressure (p) of the discharge gas and a discharge initiating voltage $V_{bd}$, that is, the discharge initiating voltage $V_{bd}$ can be expressed by the function of the product (d·p) of the distance (d) and the gas pressure (p). In the above expression, if the distance (d) between a pair of the sustain electrodes 12 is decreased for increasing discharge efficiency, it is required to increase the gas pressure (p), so that the reliability of the AC type plasma display device again decreases.

In addition to the above necessity to increase in brightness, it is also required to improve a contrast. It is known that visible light components generated by the light emission of the discharge gas cause the contract on the panel to decrease. When a neon (Ne) gas is used as a discharge gas, particularly, the visible light component generated by the light emission of the neon gas has orange color. When the neon gas concentration is high, image display on the screen of the AC type plasma display device has a color tone based mainly on orange color, and the contrast is decreased.

OBJECT AND SUMMARY OF THE INVENTION

It is therefore an object of the present invention to provide an alternating current driven type plasma display device which has high reliability, can attain a high contrast, can give a high brightness even at a low discharge gas pressure, can decrease a discharge voltage and can decrease a driving power, i.e., consumption power.

An alternating current driven type plasma display device according to a first aspect of the present invention for achieving the above object is characterized in that a discharge gas charged in a discharge space where discharge takes place consists of a xenon (Xe) gas alone (i.e., 100% by volume of a xenon gas) and that the discharge gas has a pressure of $9.0\times10^4$ Pa or lower. When the pressure of the discharge gas exceeds $9.0\times10^4$ Pa, a frit seal of the alternating current driven type plasma display device may cause a decrease in reliability due to the pressure of the discharge gas.

An alternating current driven type plasma display device according to a second aspect of the present invention for achieving the above object is characterized in that a discharge gas charged in a discharge space where discharge takes place consists of a krypton (Kr) gas alone (i.e., 100% by volume of a krypton gas) and that the discharge gas has a pressure of $9.0\times10^4$ Pa or lower. When the pressure of the discharge gas exceeds $9.0\times10^4$ Pa, a frit seal of the alternating current driven type plasma display device may cause a decrease in reliability due to the pressure of the discharge gas.

An alternating current driven type plasma display device according to a third aspect of the present invention for achieving the above object is characterized in that a discharge gas charged in a discharge space where discharge takes place consists of a mixed gas of a xenon (Xe) gas and a krypton (Kr) gas alone and that the mixed gas have a total pressure of less than $6.6\times10^4$ Pa (500 Torr). In this case, essentially, the xenon gas/krypton gas mixing ratio in the above mixed gas may be any mixing ratio.

An alternating current driven type plasma display device according to a fourth aspect of the present invention for achieving the above object is characterized in that a discharge gas charged in a discharge space where discharge takes place consists of a mixed gas of at least one first gas selected from the group consisting of a xenon (Xe) gas and a krypton (Kr) gas and at least one second gas selected from the group consisting of a neon (Ne) gas, a helium (He) gas and an argon (Ar) gas, and that the first gas has a partial pressure of at least $1\times10^3$ Pa, preferably at least $4\times10^3$ Pa and a concentration of at least 10% by volume, preferably at least 30% by volume and that the discharge gas has a total pressure of less than $6.6\times10^4$ Pa (500 Torr).

The following Table 1 summarizes combinations of gases for the first gas and the second gas in the alternating current driven type plasma display device according to the fourth aspect of the present invention. Of the cases 1 to 21, it is practically the most preferred to select the case 1. In Table 1, symbol "+" means the use of two or three kinds of gases, and when two or three kinds of gases are used, the mixing ratio thereof is essentially determined to be any ratio. Other gas such as a hydrogen ($H_2$) gas of 1%, or less than 1% by volume may be included in the mixed gas.

TABLE 1

| Case | First gas | Second gas |
|---|---|---|
| 1 | Xe | Ne |
| 2 | Xe | He |
| 3 | Xe | Ar |
| 4 | Kr | Ne |
| 5 | Kr | He |
| 6 | Kr | Ar |
| 7 | Xe | (Ne + He) |
| 8 | Xe | (Ne + Ar) |
| 9 | Xe | (He + Ar) |
| 10 | Xe | (Ne + He + Ar) |
| 11 | Kr | (Ne + He) |
| 12 | Kr | (Ne + Ar) |
| 13 | Kr | (He + Ar) |
| 14 | Kr | (Ne + He + Ar) |
| 15 | (Xe + Kr) | Ne |
| 16 | (Xe + Kr) | He |
| 17 | (Xe + Kr) | Ar |
| 18 | (Xe + Kr) | (Ne + He) |
| 19 | (Xe + Kr) | (Ne + Ar) |
| 20 | (Xe + Kr) | (He + Ar) |
| 21 | (Xe + Kr) | (Ne + He + Ar) |

An alternating current driven type plasma display device according to a fifth aspect of the present invention for achieving the above object is characterized in that a discharge gas charged in a discharge space where discharge takes place consists of a mixed gas containing a xenon (Xe) gas, that the xenon (Xe) gas has a concentration of at least 10% by volume, preferably at least 30% by volume, but less than 100% by volume and that the mixed gas has a total pressure of less than $6.6\times10^4$ Pa (500 Torr).

In the alternating current driven type plasma display device according to the fifth aspect of the present invention, the partial pressure of the xenon (Xe) gas is preferably at least $1\times10^3$ Pa, more preferably at least $4\times10^3$ Pa. The other gas for the mixed gas includes a krypton (Kr) gas, a neon (Ne) gas, a helium (He) gas and an argon (Ar) gas.

Each of the alternating current driven type plasma display devices according to the first to fifth aspects of the present invention (to be sometimes generally and simply referred to as "plasma display device" hereinafter) has a plurality of pairs of sustain electrodes, and discharge takes place between each pair of the sustain electrodes. The distance between a pair of the sustain electrodes may be arbitrary so long as necessary glow discharge can take place at a predetermined discharge voltage. For decreasing a discharge voltage, however, the above distance is less than $5\times10^{-5}$ m, preferably less than $5.0\times10^{-5}$ m, more preferably equal to, or less than, $2\times10^{-5}$ m. There may be employed a constitution in which one sustain electrode between a pair of the sustain electrodes is formed on the first substrate and the other sustain electrode is formed on the second substrate. The thus-constituted plasma display device will be referred to as bi-electrode type for the convenience. In this case, the projection image of one sustain electrode extends in a first direction, the projection image of the other sustain electrode extends in a second direction different from the first direction, and a pair of the sustain electrodes are arranged such that one sustain electrode faces the other. Otherwise, there may be employed a constitution in which a pair of the sustain electrodes are formed on the first substrate and a so-called address electrode is formed on the second substrate. The thus-constituted plasma display device will be referred to as tri-electrode type for the convenience. In this case, there may be employed a constitution in which the projection image of a pair of the sustain electrodes extends in a first direction such that the projection image of one sustain electrode extends in parallel with the projection image of the other, the projection image of the address electrode extends in a second direction, and a pair of the sustain electrodes and the address electrode are arranged such that a pair of the sustain electrodes face the address electrode, but the constitution shall not be limited to the above constitution. In these cases, in view of the structural simplification of the plasma display device, preferably, the first direction and the second direction cross each other at right angles. Further, there may be also employed a constitution in which a pair of the sustain electrodes and the address electrode are formed on the first substrate.

In the plasma display device according to any one of the first to fifth aspects of the present invention, the form of a gap between the edge portions of a pair of the sustain electrodes may be linear. Otherwise, the form of the above gap may have a pattern bent or curved in the width direction of the sustain electrode. In this case, the area of portions of the sustain electrodes which portions contribute to discharging can be increased.

The plasma display device of the present invention will be explained with reference to the tri-electrode type plasma display device hereinafter. For the bi-electrode type plasma display device, "address electrode" in the following explanation can be taken as "the other sustain electrode" as required.

The electrically conductive material constituting the sustain electrode differs depending upon whether the plasma display device is a transmissiton type or a reflection type. In the transmission type plasma display device, light emission from the fluorescence layers is observed through the second substrate, so that it is not any problem whether the electrically conductive material constituting the sustain electrode is transparent or non-transparent. However, since the address electrode is formed on the second substrate, the address electrode is required to be transparent. In the reflection type plasma display device, light emission from the fluorescence layers is observed trough the first substrate, so that it is not any problem whether the electrically conductive material constituting the address electrode is transparent or non-transparent. However, the electrically conductive material constituting the sustain electrode is required to be transparent. The term "transparent or non-transparent" is based on the transmissivity of the electrically conductive material to light at a wavelength of emitted light (in visible light region) inhererent to fluorescence materials. That is, when an electrically conductive material constituting the sustain electrode or the address electrode is transparent to light emitted from the fluorescence layers, it can be said that the electrically conductive material is transparent. The non-transparent electrically conductive material includes Ni, Al, Au, Ag, Pd/Ag, Cr, Ta, Cu, Ba, $LaB_6$, $Ca_{0.2}La_{0.8}CrO_3$, etc., and these materials may be used alone or in combination. The transparent electrically conductive material includes ITO (indium-tin oxide) and $SnO_2$. The sustain electrode and the address electrode can be formed by a sputtering method, a deposition method, a screen printing method, a sand blasting method, a plating method or a lift-off method.

There may be employed a constitution in which, in addition to the sustain electrode, a bus electrode composed of a material having a lower electric resistivity than the sustain electrode is formed in contact with the sustain electrode for decreasing the impedance of the sustain electrode as a whole. The bus electrode can be composed, typically, of a metal material such as Ag, Au, Al, Ni, Cu, Mo, Cr or a Cr/Cu/Cr stacked film. In the reflection type plasma display device, the bus electrode composed of the above metal material can be a factor to decrease a transmission quantity of visible light which is emitted from the fluorescence layers and passes through the first substrate, so that the brightness of a display screen is decreased. It is therefore preferred to form the bus electrode so as to be as narrow as possible so long as an electric resistance value necessary for the sustain electrode as a whole can be obtained. The bus electrode can be formed by a sputtering method, a deposition method, a screen printing method, a sand blasting method, a plating method or a lift-off method.

Preferably, a dielectric material layer is formed on the surface of the sustain electrode, for example, by an electron beam deposition method, a sputtering method, a deposition method or a screen printing method. When the dielectric material layer is formed, the direct contact of ions or electrons to the sustain electrode can be prevented, and as a result, the wearing of the sustain electrode can be prevented. The dielectric material layer works to accumulate a wall charge, works as a resistor to limit an excess discharge current and works as a memory to sustain a discharge state. The dielectric material layer can be composed, typically, of a low-melting glass or silicon oxide, or it can be also formed from other dielectric material.

More preferably, a protective layer is formed on the dielectric material layer. When the protective layer is formed, the direct contact of ions or electrons to the sustain electrode can be prevented, and as a result, the wearing of the sustain electrode can be prevented. The protective layer also works to emit secondary electrons necessary for discharge. The material constituting the protective layer includes magnesium oxide (MgO), magnesium fluoride ($MgF_2$) and calcium fluoride ($CaF_2$). Of these, magnesium oxide is a suitable material having properties such as a high emission ratio of secondary electrons, a low sputtering ratio, a high light transmissivity at a wavelength of light emitted from the fluorescence layers and a low discharge intiating voltage. The protective layer may be constituted of a stacked structure composed of at least two materials selected from the group consisting of these materials.

In the plasma display device of the present invention, examples of the material constituting the first substrate for the first panel and the second substrate for the second panel include high-distortion-point glass, soda glass ($Na_2O{\cdot}CaO{\cdot}SiO_2$), borosilicate glass ($Na_2O{\cdot}B_2O_3{\cdot}SiO_2$), forsterite ($2MgO{\cdot}SiO_2$) and lead glass ($Na_2O{\cdot}PbO{\cdot}SiO_2$). The material for the first substrate and the material for the second substrate may be the same as, or different from, each other.

The fluorescence layer is composed of a fluorescence material selected from the group consisting of a fluorescence material which emits light in red, a fluorescence material which emits light in green and a fluorescence material which emits light in blue. The fluorescence layer is formed on or above the address electrode. When the plasma display device is for displaying in colors, specifically, the fluorescence layer composed of a fluorescence material which emits light, for example, of a red color (red fluorescence layer) is formed on or above the address electrode, the fluorescence layer composed of a fluorescence material which emits light, for example, of a green color (green fluorescence layer) is formed on or above another address electrode, and the fluorescence layer composed of a fluorescence material which emits light, for example, of a blue color (blue fluorescence layer) is formed on or above still another address electrode. These three fluorescence layers for emitting light of three primary colors form one set, and such sets are formed in a predetermined order. A region where a pair of the sustain electrodes and one set of the fluorescence layers which emit light of three primary colors overlap corresponds to one pixel. Each of the red fluorescence layer, the green fluorescence layer and the blue fluorescence layer may be formed in the form of a stripe, or may be formed in the form of a dot. Further, the fluorescence layers may be formed only on regions where the sustain electrodes and the address electrodes overlap.

As the fluorescence material for constituting the fluorescence layers, fluorescence materials which have high quantum efficiency and causes less saturation to vacuum ultraviolet ray can be selected from known fluorescence materials as required. When the plasma display device is assumed to be used as a color display, it is preferred to combine those fluorescence materials which have color purities close to three primary colors defined in NTSC, which give excellent white balance when three primary colors are mixed, which show a small afterglow time period and which can secure that the afterglow time periods of three primary colors are nearly equal. Examples of the fluorescence material which emits light in red when irradiated with vacuum ultraviolet ray include ($Y_2O_3$:Eu), ($YBO_3$Eu), ($YVO_4$:Eu), ($Y_{0.96}P_{0.60}V_{0.40}O_4$:$Eu_{0.04}$), [(Y,Gd)$BO_3$:Eu], ($GdBO_3$:Eu), ($ScBO_3$:Eu) and ($3.5MgO{\cdot}0.5MgF_2{\cdot}GeO_2$:Mn). Examples of the fluorescence material which emits light in green when irradiated with vacuum ultraviolet light include ($ZnSiO_2$:Mn), ($BaAl_{12}O_{19}$:Mn), ($BaMg_2Al_{16}O_{27}$:Mn), ($MgGa_2O_4$:Mn), ($YBO_3$:Tb), ($LuBO_3$:Tb) and ($Sr_4Si_3O_8Cl_4$:Eu). Examples of the fluorescence material which emits light in blue when irradiated with vacuum ultraviolet ray include ($Y_2SiO_5$:Ce), ($CaWO_4$:Pb), $CaWO_4$, $YP_{0.85}V_{0.15}O_4$, ($BaMgAl_{14}O_{23}$:Eu), ($Sr_2P_2O_7$:Eu) and ($Sr_2P_2O_7$:Sn). The method for forming the fluorescence layers includes a thick film printing method, a method in which fluorescence particles are sprayed, a method in which an adhesive substance is pre-applied to a region where the fluorescence layers are to be formed and fluorescence particles are allowed to adhere, a method in which a photosensitive fluorescence paste (slurry) is provided and a fluorescence layer is patterned by exposure and development, and a method in which a fluorescence layer is formed on the entire surface and unnecessary portions are removed by a sand blasting method.

The fluorescence layer may be formed directly on the address electrode or may be formed on the address electrode and on the side walls of the separation wall. Otherwise, the fluorescence layer may be formed on the dielectric film formed on the address electrode or may be formed on the dielectric film formed on the address electrode and on the side walls of the separation wall. Further, the fluorescence layer may be formed only on the side walls of the separation wall. The material constituting the dielectric film includes a low-melting glass and silicon oxide, and it can be formed by a screen printing method, a sputtering method or a vacuum deposition method. In some cases, a protective layer composed of magnesium oxide (MgO), magnesium fluoride ($MgF_2$) or calcium fluoride ($CaF_2$) may be formed on the fluorescence layer and the separation wall.

Preferably, the separation walls (ribs) extending in parallel with the address electrodes are formed on the second substrate. The separation wall (rib) may have a meander structure. When the dielectric film is formed on the second substrate and on the address electrode, the separation wall may be formed on the dielectric film in some cases. The material constituting the separation wall can be selected from a known insulating material. For example, a mixture of a widely used low-melting glass with a metal oxide such as alumina can be used. The separation wall can be formed by a screen printing method, a sand blasting method, a dry filming method and a photosensitive method. The above screen printing method refers to a method in which opening portions are formed in those portions of a screen which correspond to portions where the separation walls are to be formed, a separation-wall-forming material on the screen is passed through the opening portion with a squeeze to form a separation-wall-forming material layer on the second substrate or the dielectric film (these will be generically referred to as "second substrate or the like" hereinafter), and then the separation-wall-forming material layer is calcined or sintered. The above dry filming method refers to a method in which a photosensitive film is laminated on the second substrate or the like, the photosensitive film on regions where the separation walls are to be formed is removed by exposure and development, opening portions formed by the removal are filled with a separation-wall-forming material and the separation-wall-forming material is calcined or sintered. The photosensitive film is combusted and removed by the calcining or sintering and the separation-wall-forming material filled in the opening portions remains to constitute the separation walls. The above photosensitive method refers to a method in which a photosensitive material layer for forming the separation walls is formed on the second substrate or the like, the photosensitive material layer is patterned by exposure and development and then the patterned photosensitive material layer is calcined or sintered. The above sand blasting method refers to a method in which a separation-wall-forming material layer is formed on the second substrate or the like, for example, by screen printing or with a roll coater, a doctor blade or a nozzle-ejecting coater and is dried, then, those portions where the separation walls are to be formed in the separation-wall-forming material layer are masked with a mask layer and exposed portions of the separation-wall-forming material layer are removed by a sand blasting method. The separation walls may be formed in black to form a so-called black matrix. In this case, a high contrast of the display screen can be attained. The method of forming the black separation walls includes a method in which the separation walls are formed from a color resist material colored in black.

One discharge cell is constituted of a pair of the separation walls formed on or above the second substrate, and the sustain electrodes, the address electrode and the fluorescence layer (one fluorescence layer of a red fluorescence layer, a green fluorescence layer or a blue fluorescence layer) which occupy a region surrounded by the pair of the separation walls. The discharge gas is sealed in the above discharge cell, more specifically, the discharge space surrounded by the separation walls, and the fluorescence layer emits light when irradiated with vacuum ultraviolet ray generated by AC glow discharge which takes place in the discharge gas in the discharge space.

In the alternating current driven type plasma display device according to the first aspect of the present invention, the discharge gas composed of a xenon (Xe) gas alone is used. In the alternating current driven type plasma display device according to the second aspect of the present invention, the discharge gas composed of a krypton (Kr) gas alone is used. In the alternating current driven type plasma display device according to the third aspect of the present invention, the discharge gas consisting of a mixture of a xenon (Xe) gas and a krypton (Kr) gas alone is used. Therefore, the pressure of the xenon or krypton gas which contributes to light emission can be relatively remarkably increased as compared with the counterpart in a conventional alternating current driven type plasma display device. As a result, the light emission efficiency is improved, and the stability of discharge can be maintained even if the total pressure of the discharge gas is maintained at a lower level. At the same time, a brightness higher than the counterpart obtained by increasing the discharge gas pressure can be achieved.

In the alternating current driven type plasma display device according to the fourth aspect of the present invention, mainly, the first gas contributes to the light emission of the fluorescence layers. And, since the discharge gas consists of a mixture of the first gas with the second gas, the discharge initiating voltage $V_{bd}$ can be decreased due to a Penning effect. Further, the partial pressure and the concentration of the first gas are defined, and the volume ratio of, for example, a xenon (Xe) gas in the mixed gas is increased, so that the brightness of the alternating current driven type plasma display device can be increased.

In the alternating current driven type plasma display device according to the fifth aspect of the present invention, mainly, a xenon gas contributes to the light emission of the fluorescence layers. And, since the discharge gas consists of the mixed gas of a xenon gas, the brightness of the alternating current driven type plasma display device can be increased. Further, the concentration of the xenon gas in the mixed gas is defined, so that the discharge initiating voltage $V_{bd}$ relative to the value of brightness can be decreased and that the light emission efficiency can be accordingly improved.

Meanwhile, the plasma display device is with the law of Paschen as explained already, that is, the discharge initiating voltage $V_{bd}$ can be expressed by the function of the product (d·p) of the distance (d) and the gas pressure (p). In the plasma display device of the present invention, the distance (d) of a pair of the sustain electrodes is defined to be less than $5\times10^{-5}$ m, preferably, less than $5.0\times10^{-5}$ m, more preferably, $2\times10^{-5}$ m or less. In this case, not only the discharge initiating voltage $V_{bd}$ can be decreased, but also the pressure or partial pressure of the gas which contributes to light emission (a xenon gas, a krypton gas or the first gas) can be further increased, so that the brightness of the plasma display device can be further increased.

BRIEF DESCRIPTION OF THE DRAWINGS

The present invention will be explained on the basis of Examples with reference to drawings.

DESCRIPTION OF THE PREFERRED EMBODIMENTS

Figure 1:
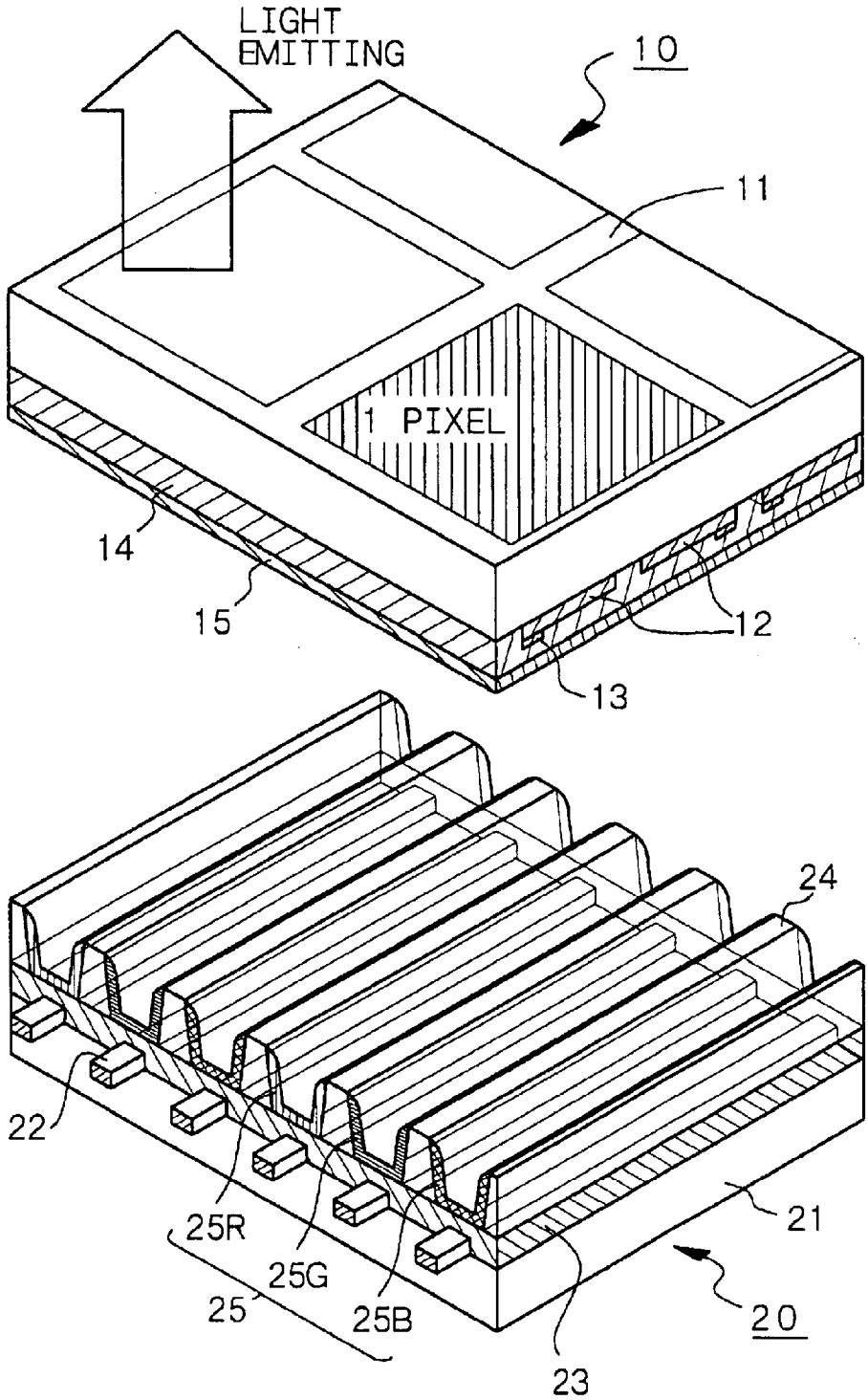
Fig. 1 RELATED ART
FIG. 1 is a schematic partial exploded perspective view of a general constitution example of a tri-electrode type alternating current driven type plasma display device.

A tri-electrode type plasma display device having a structure shown in FIG. 1 was fabricated by the following method. Plasma display devices to be explained below are plasma display devices for various tests and differ from plasma display devices to be mass-produced practically. Therefore, evaluation of brightness values obtained by a brightness measurement is not any absolute evaluation and is relative evaluation.

A first panel 10 was produced by the following method. First, an ITO layer was formed on the entire surface of a first substrate 11 made of a high-distortion-point glass or a soda glass, for example, by a sputtering method, and the ITO layer was patterned in the form of stripes by photolithography and etching, to form a plurality of pairs of sustain electrodes 12. The sustain electrodes 12 extend in a first direction. Then, an aluminum layer was formed on the entire surface, for example, by a deposition method, and the aluminum layer was patterned by photolithography and etching to form bus electrodes 13 along the edge portions of the sustain electrodes 12. Then, a dielectric material layer 14 which, for example, had a thickness of 3 $\mu$m and was composed of silicon oxide ($SiO_2$) was formed on the entire surface, and a 0.6 $\mu$m thick protective layer 15 composed of magnesium oxide (Mgo) was formed thereon by an electron beam deposition method. By the above steps, the first panel 10 can be completed.

A second panel 20 was produced by the following method. First, a silver paste was printed on a second substrate 21 made of a high-distortion-point glass or a soda glass by a screen printing method such that the silver paste had the form of stripes, and then the silver paste was calcined or sintered to form address electrode 22. The address electrode 22 extends in a second direction which crosses the first direction at right angles. Then, a low-melting glass paste layer was formed on the entire surface by a screen printing method, and the low-melting glass paste layer was calcined or sintered to form a dielectric film 23. Then, a low-melting glass paste was printed on the dielectric film 23 above a region between one address electrode 22 and another address electrode 22, for example, by a screen printing method, and calcined or sintered to form separation walls 24. The separation wall had an average height of 130 $\mu$m. Fluorescence material slurries of three primary colors were consecutively printed and calcined or sintered to form each of fluorescence layers 25R, 25G and 25B on the dielectric film 23 between one separation wall 24 and another separation wall 24 and on the side walls of each separation wall 24. By the above steps, the second panel 20 can be completed.

Then, a plasma display device was assembled. That is, a seal layer made of a frit glass was formed on a circumferential portion of the second panel 20. Then, the first panel 10 and the second panel 20 were attached to each other and then calcined or sintered to cure the seal layer. Then, a space formed between the first panel 10 and the second panel 20 was vacuumed, charged with a discharge gas and sealed to complete the plasma display device.

For a testing purpose, the sustain electrodes 12 was determined to have a width of 0.2 mm and a thickness of approximately 0.3 $\mu$m. There were prepared plasma display devices for testing, in which the distance (d) between a pair of the sustain electrodes 12 was 10 $\mu$m, 20 $\mu$m, 40 $\mu$m or 70 $\mu$m.

One example of glow discharge operation of the thus-constituted plasma display device will be explained below. First, for example, a pulse voltage higher than a discharge initiating voltage $V_{bd}$ is applied to all of one sustain electrodes between pairs of the sustain electrodes 12 for a short time of period, whereby glow discharge takes place, and a wall charge is generated and accumulated on the surface of the dielectric material layer 14 near the one sustain electrode between a pair of the sustain electrodes 12 due to dielectric polarization, so that an apparent discharge initiating voltage decreases. Then, while a voltage is applied to the address electrode 22, a voltage is applied to the one sustain electrode between a pair of the sustain electrodes 12 included in the discharge cell which is not driven for display, whereby glow discharge is allowed to take place between the address electrode 22 and the one sustain electrode between a pair of the sustain electrodes 12 to erase the accumulated wall charge. The above discharge for erasing is carried out consecutively in the address electrodes 22. On the other hand, no voltage is applied to the one sustain electrode between a pair of the sustain electrodes included in the discharge cell which is driven for display, whereby the accumulation of the wall charge is sustained. Then, a predetermined pulse voltage is applied between all of pairs of the sustain electrodes 12. As a result, in the cell where the wall charge is accumulated, glow discharge starts between each pair of the sustain electrodes 12, and in the discharge cell, the fluorescence layer excited by irradiation with vacuum ultraviolet ray generated on the basis of the glow discharge in the discharge gas in the discharge space emits light in color inherent to the fluorescence material. The phase of the discharge sustain voltage applied to one sustain electrode between a pair of the sustain electrodes and the phase of the discharge sustain voltage applied to the other sustain electrode between a pair of the sustain electrodes deviate by half a cycle, and the polarity of the sustain electrodes is reversed depending upon the frequency of alternating current.

EXAMPLE 1

Figure 4:
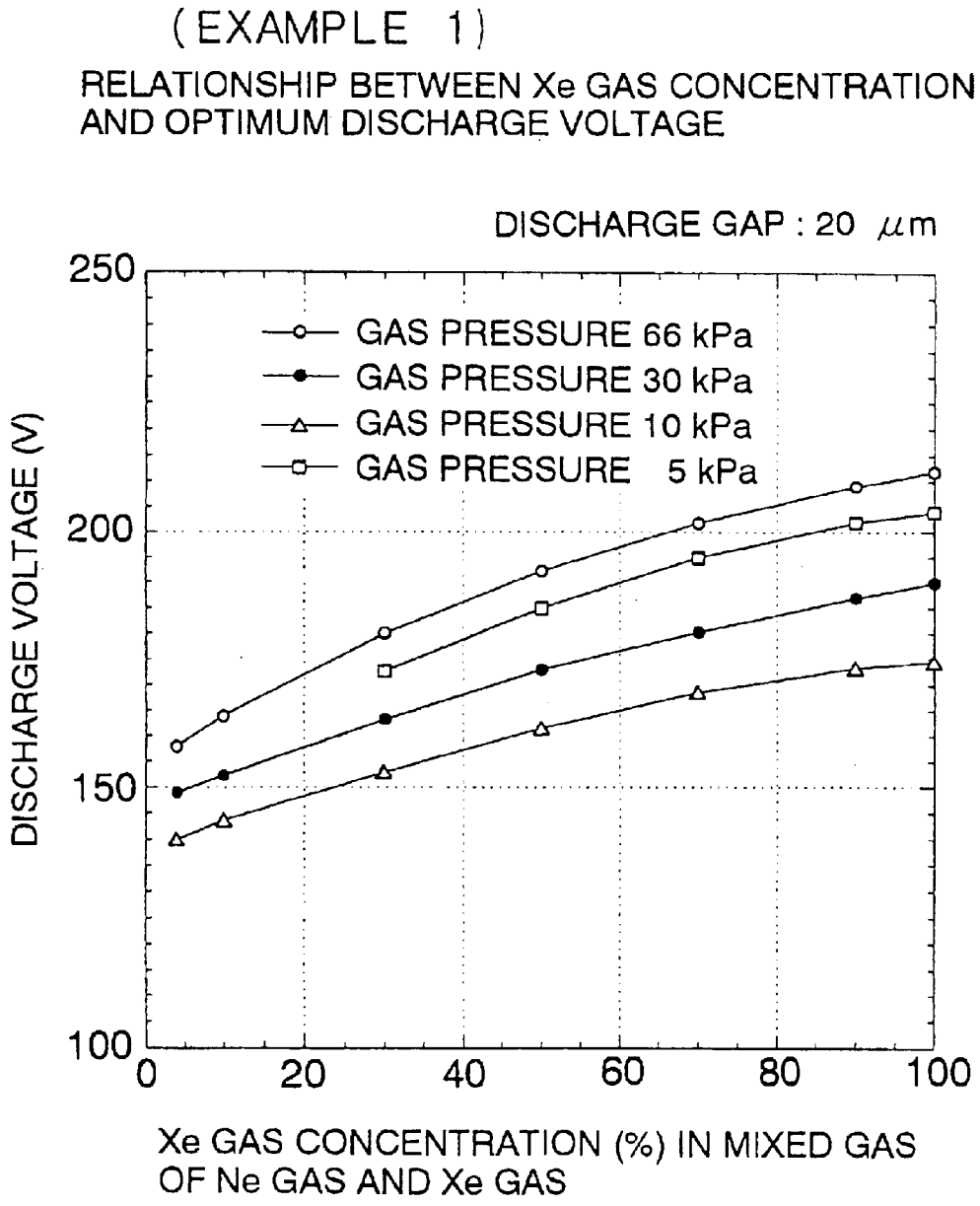
FIG. 4 is a graph showing relationships between Xe gas concentrations and optimum discharge voltages with regard to total gas pressures in the plasma display devices of Example 1.

Example 1 is concerned with the plasma display devices according to the first, fourth and fifth aspects of the present invention. Example 1 used the plasma display devices for testing in which the distance between a pair of the sustain electrodes 12 was constant or 20 $\mu$m. Example 1 used a mixed gas of a xenon (Xe) gas as a first gas and a neon (Ne) gas as a second gas. While the Xe gas concentration was varied between 4% by volume and 100% by volume, the total pressure of the mixed gas was set at $5\times10^3$ Pa (indicated by hollow squares in FIGS. 2 and 4), $1\times10^4$ Pa (indicated by hollow triangles in FIGS. 2 and 4), $3\times10^4$ Pa (indicated by solid circles in FIGS. 2 and 4) or $6.6\times10^4$ Pa (indicated by hollow circles in FIGS. 2 and 4). The plasma display devices for testing under such conditions were measured for brightness. The voltage to be applied was set at an optimum level depending upon the total pressure in each gas mixture, and FIG. 4 shows the optimum discharge voltages with regard to the total pressures. In the drawings, the pressure is shown in the unit of "kPa", and the distance between a pair of the sustain electrodes is shown as "Discharge gap".

Figure 2:
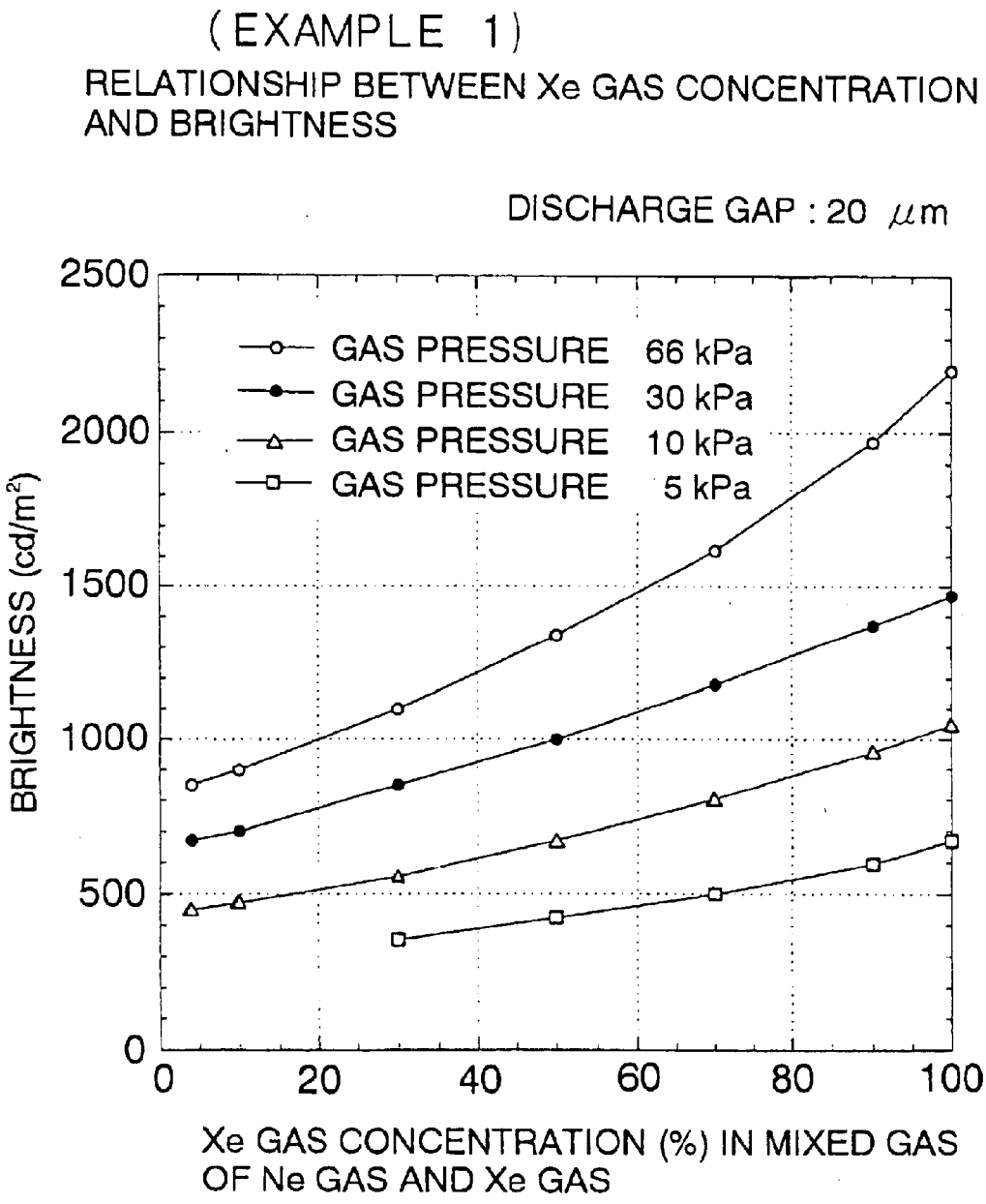
FIG. 2 is a graph showing relationships between Xe gas concentrations and brightness measurement results with regard to total gas pressures in the plasma display devices of Example 1.
Figure 3:
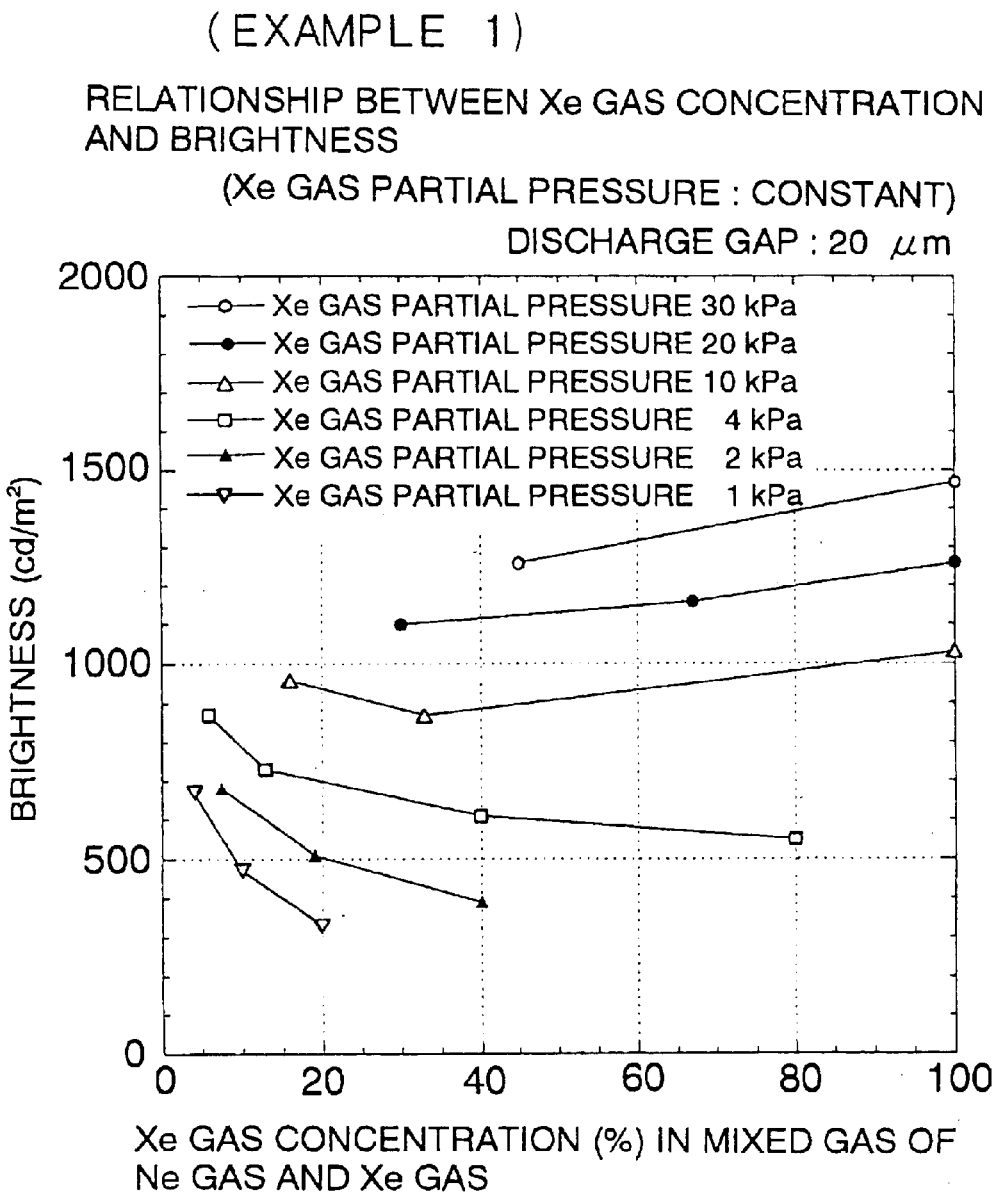
FIG. 3 is a graph showing relationships between Xe gas concentrations and brightness measurement results with regard to Xe gas partial pressures in the plasma display devices of Example 1.

FIGS. 2 and 3 show results of brightness measurement of the prepared plasma display devices. FIG. 2 is a graph showing the relationships between the Xe gas concentrations and the brightness measurement results with regard to the total gas pressures. FIG. 3 is a graph showing the relationships between the Xe gas concentrations and the brightness measurement results with regard to the Xe gas partial pressures on the basis of data shown in FIG. 2. FIG. 2 clearly shows that with an increase in the Xe gas concentration, the brightness increases. Further, FIG. 3 clearly shows that with an increase in the partial pressure of a Xe gas, the brightness increases. When the Xe gas pressure is particularly 30% by volume or higher, a high brightness can be attained. Further, with an increase in the Xe gas concentration, the brightness increases. In this case, the partial pressure of the Xe gas is required to be at least $1\times10^3$ Pa. When the partial pressure of the Xe gas is lower than the above level, the discharge initiating voltage comes to be extremely high due to the law of Paschen. Further, as shown in FIGS. 2 and 4, when the total pressure of the mixed gas is less than $6.6\times10^4$ Pa, the discharge voltage can be maintained at approximately 200 volts or lower, and a high brightness can be also attained. When the Xe gas concentration is particularly 100% by volume, that is, when the discharge gas consists of a xenon gas alone, a very high brightness can be attained even if the xenon gas concentration is $6.6\times10^4$ Pa or higher, which sufficiently offsets an increase in the discharge voltage. Therefore, the total pressure of the discharge gas can be decreased, and a high brightness can be attained without incurring a decrease in reliability caused, for example, by a frit seal.

EXAMPLE 2

Example 2 used plasma display devices for testing in which the distance between a pair of the sustain electrodes 12 was 10 $\mu$m, 20 $\mu$m, 40 $\mu$m or 70 $\mu$m. And, the plasma display devices having a xenon gas pressure of $1.0\times10^4$ Pa and a xenon gas concentration of 100% by volume were measured for brightness.

Figure 5:
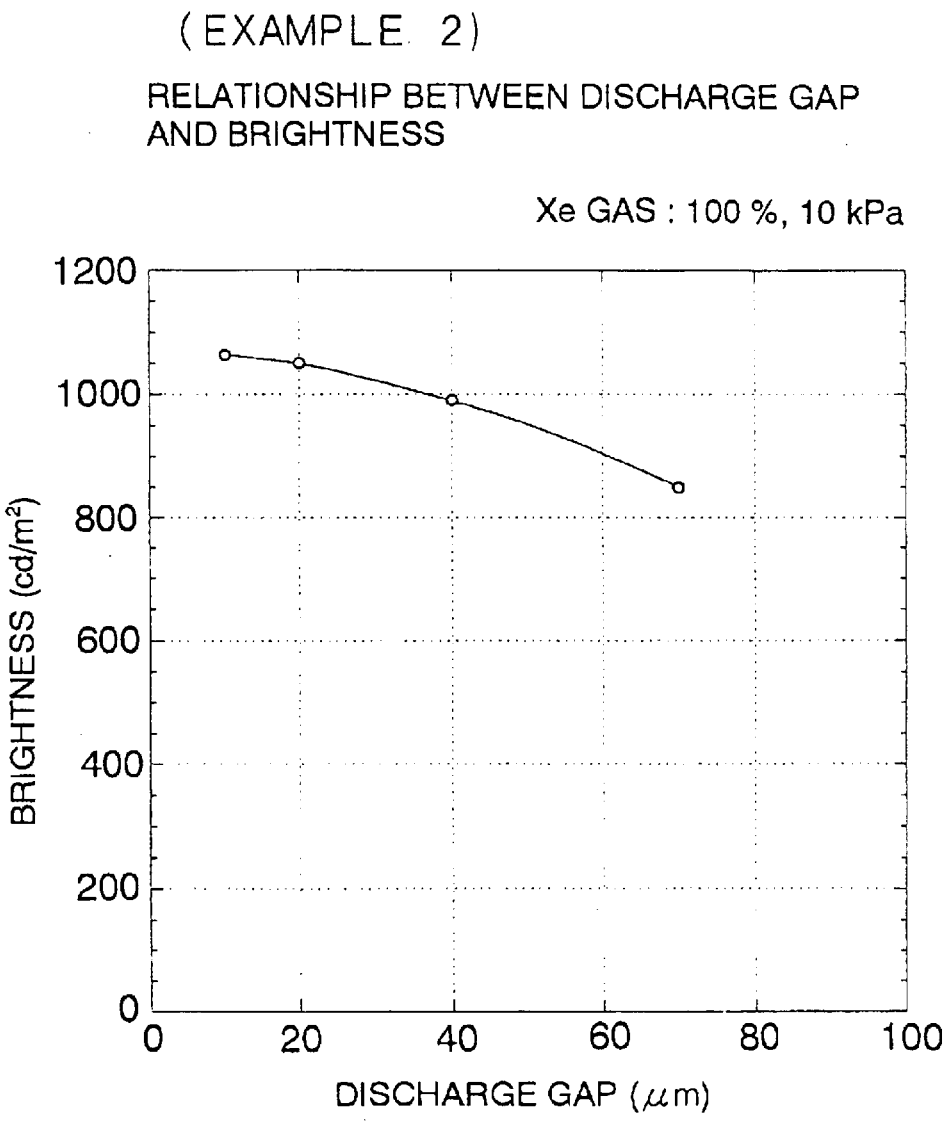
FIG. 5 is a graph showing a relationship between a distance between a pair of sustain electrodes and a brightness measurement result in the plasma display devices of Example 2.

FIG. 5 shows results of the brightness measurement of the prepared plasma display devices. FIG. 5 clearly shows that the brightness tends to increase with a decrease in the distance between a pair of the sustain electrodes 12. That is, it is seen that when the distance between a pair of the sustain electrodes is less than $5\times10^{-5}$ m, preferably less than $5.0\times10^{-5}$ m, more preferably $2\times10^{-5}$ m or less, higher brightness can be obtained.

Further, in cases using other discharge gases, that is, in the plasma display devices according to the second to fifth aspects of the present invention, similarly, the brightness tends to increase with a decrease in the distance between a pair of the sustain electrodes 12.

EXAMPLE 3

Example 3 is concerned with the plasma display devices according to the first, second and third aspects of the present invention. Example 3 used plasma display devices in which the distance between a pair of the sustain electrodes 12 was constant or 20 $\mu$m, and the discharge gas consisted of a xenon gas and a krypton gas alone.

Figure 6:
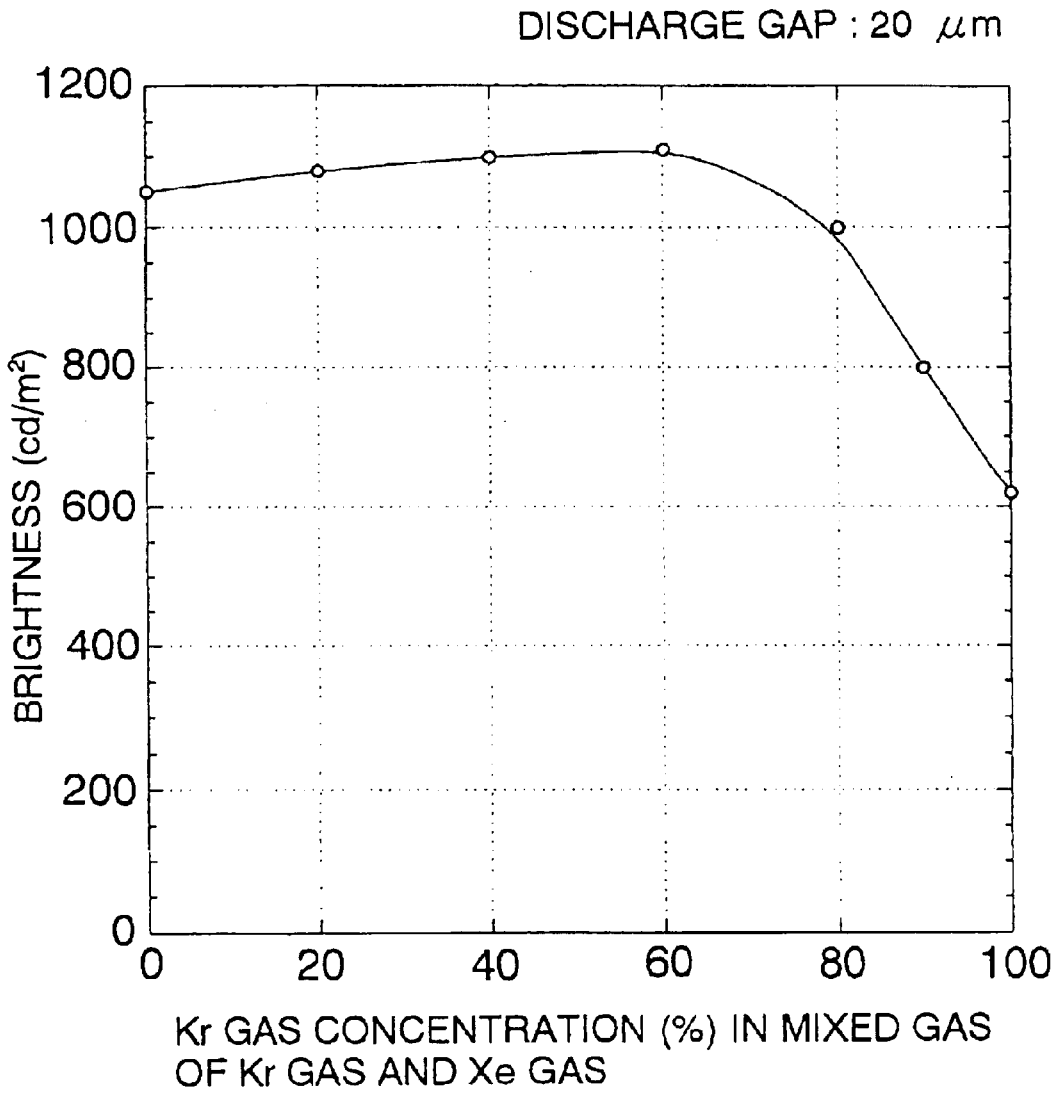
FIG. 6 is a graph showing a relationship between a Kr gas concentration in a mixed gas of Xe gas and Kr gas and a brightness measurement result in the plasma display devices of Example 3.

FIG. 6 shows results of the brightness measurement of the prepared plasma display devices. The results shown in FIG. 6 are results of brightness measurements when the total pressure of the mixed gas of a xenon gas and a krypton gas alone was constant or $1\times10^4$ Pa (10 kPa) and the concentration ratio of the Kr gas was varied between 0% and 100%. FIG. 6 clearly shows that the use of the mixed gas of a Xe gas and a Kr gas as a discharge gas gives a higher brightness than the use of a Xe gas alone or a Kr gas alone. Like the results shown in Example 1, further, the mixed gas of a Xe gas and a Kr gas give a higher brightness even when the total pressure of the mixed gas is less than $6.6\times10^4$ Pa (500 Torr). Therefore, the total pressure of the discharge gas can be decreased, and a high brightness can be attained without incurring a decrease in reliability caused, for example, by a frit seal.

EXAMPLE 4

Figure 9:
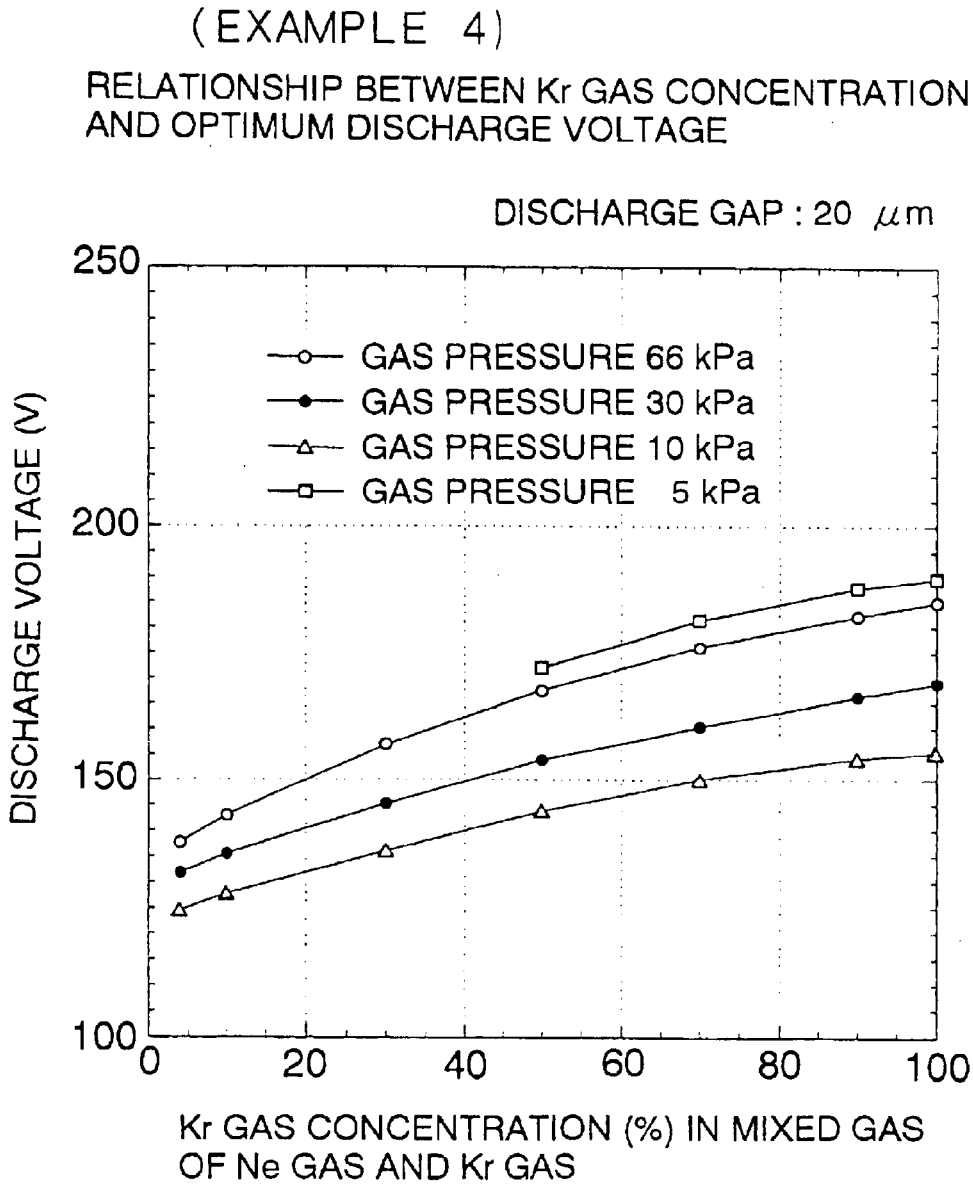
FIG. 9 is a graph showing relationships between Kr gas concentrations and optimum discharge voltages with regard to total gas pressures in the plasma display devices of Example 4.

Example 4 is concerned with the plasma display devices according to the second and fourth aspects of the present invention. Example 4 used the plasma display devices for testing in which the distance between a pair of the sustain electrodes 12 was constant or 20 $\mu$m. Further, the mixed gas of a krypton (Kr) gas as the first gas and a neon (Ne) gas as the second gas were used. While the Kr gas concentration was varied between 4% by volume and 100% by volume, the total pressure of the mixed gas was set at $5\times10^3$ Pa (indicated by hollow squares in FIGS. 7 and 9), $1\times10^4$ Pa (indicated by hollow triangles in FIGS. 7 and 9), $3\times10^4$ Pa (indicated by solid circles in FIGS. 7 and 9) or $6.6\times10^4$ Pa (indicated by hollow circles in FIGS. 7 and 9). The plasma display devices for testing under such conditions were measured for brightness. The voltage to be applied was set at an optimum level depending upon the total pressure in each gas mixture, and FIG. 9 shows the optimum discharge voltages with regard to the total pressures.

Figure 7:
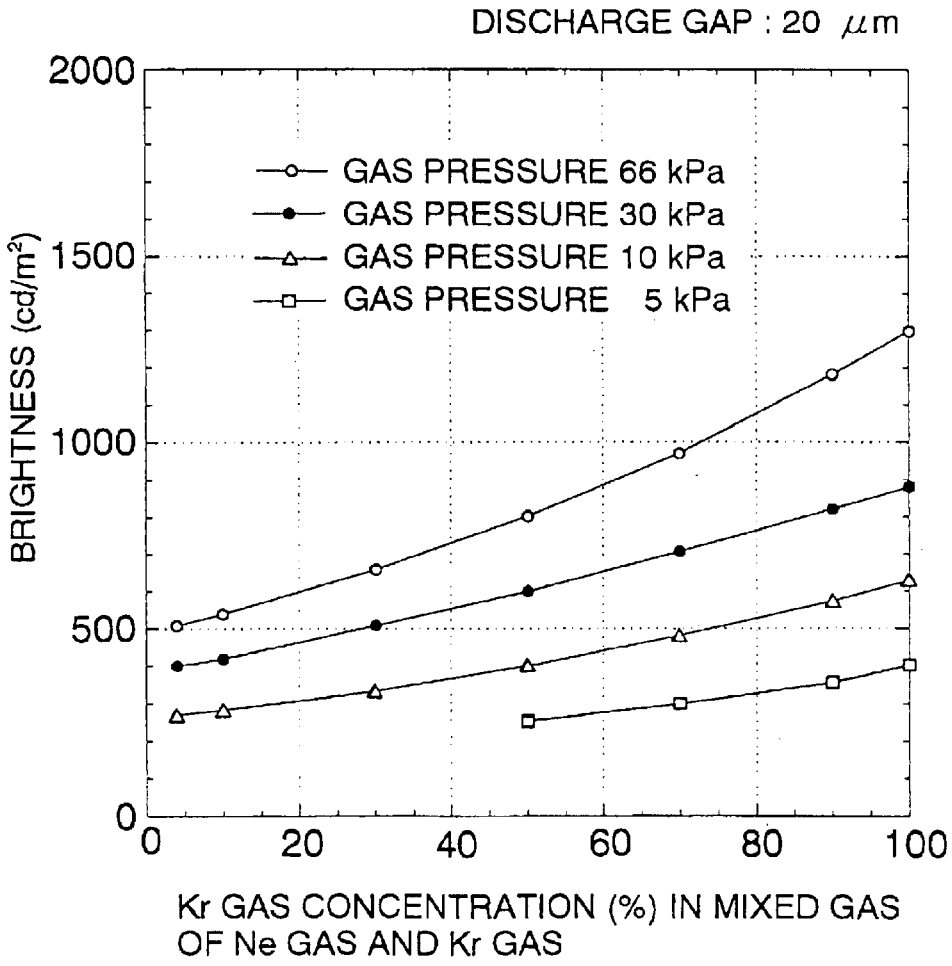
FIG. 7 is a graph showing relationships between Kr gas concentrations and brightness measurement results with regard to total gas pressures in the plasma display devices of Example 4.
Figure 8:
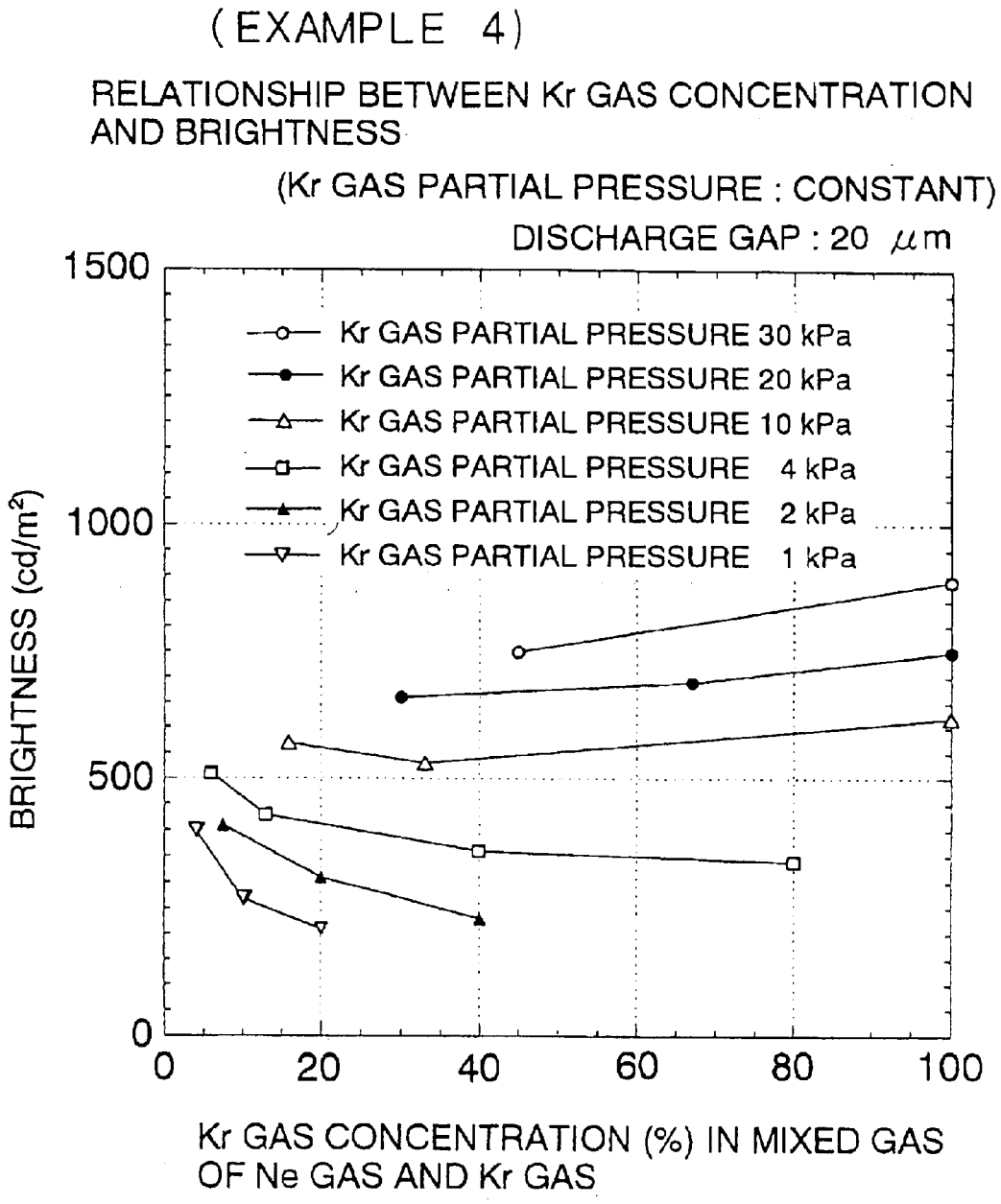
FIG. 8 is a graph showing relationships between Kr gas concentrations and brightness measurement results with regard to Kr gas partial pressures in the plasma display devices of Example 4.

FIGS. 7 and 8 show the results of the brightness measurements of the prepared plasma display devices. FIG. 7 shows a graph of the relationships between the Kr gas concentrations and the brightness measurement results with regard to the total gas pressures. FIG. 8 shows a graph of the relationships between the Kr gas concentrations and the brightness measurement results with regard to the Kr gas partial pressures on the basis of data shown in FIG. 7. FIG. 7 clearly shows that with an increase in the Kr gas concentration, the brightness increases. Further, FIG. 8 clearly shows that with an increase in the partial pressure of a Kr gas, the brightness increases. When the Kr gas pressure is particularly 30% by volume or higher, a high brightness can be attained. Further, with an increase in the Kr gas concentration, the brightness increases. In this case, the partial pressure of the Kr gas is required to be at least $1\times10^3$ Pa. When the partial pressure of the Kr gas is lower than the above level, the discharge initiating voltage comes to be extremely high due to the law of Paschen. Further, as shown in FIGS. 7 and 9, when the total pressure of the mixed gas is less than $6.6\times10^4$ Pa, the discharge voltage can be maintained at approximately 200 volts or lower, and a high brightness can be also attained. When the Kr gas concentration is particularly 100% by volume, that is, when the discharge gas consists of a krypton gas alone, a very high brightness can be attained even if the krypton gas concentration is $6.6\times10^4$ Pa or higher, which sufficiently offsets an increase in the discharge voltage. Therefore, the total pressure of the discharge gas can be decreased, and a high brightness can be attained without incurring a decrease in reliability caused, for example, by a frit seal.

EXAMPLE 5

Example 5 used a plasma display device having no fluorescence layers formed, and the plasma display device was tested for discharge and measured for brightness. In the test, the distance between a pair of the sustain electrodes 12 was 20 $\mu$m, the discharge gas consisted of 100% by volume of a Xe gas and the applied voltage was set at 150 volts. For comparison, there was prepared a plasma display device in which the distance between a pair of the sustain electrodes 12 was 20 $\mu$m and the discharge gas consisted of 4% by volume of a Xe gas and 96% by volume of a Ne gas, and the plasma display device was allowed to discharge at an applied voltage of 150 volts. These plasma display devices were measured for brightness.

Figure 10:
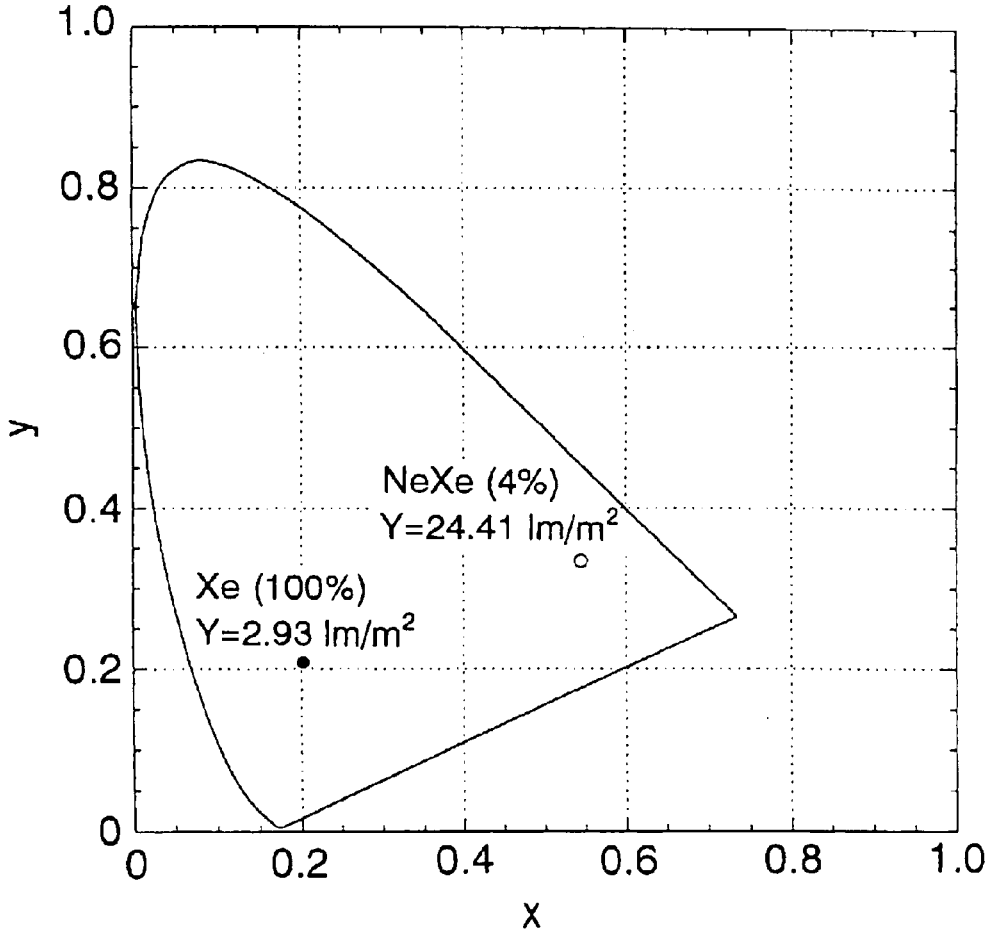
FIG. 10 is a graph showing a relationship between the brightness of light emitted from a discharge gas alone and a color of the emitted light.

Since the plasma display devices having no fluorescence materials were used, each of the brightness obtained by the measurement was data based on the light emission (visible light) of the discharge gas. FIG. 10 shows a chromaticity diagram of a relationship between a measured brightness and color of emitted light. Generally, the light emission of the discharge gas is an undesirable phenomenon since it decreases a contrast of the plasma display device. In Comparative Example (4% by volume of a Xe gas and 96% by volume of a Ne gas) shown in FIG. 10, the discharge gas showed a brightness of 24.11 ($lm/m^2$), which is not negligible. In Example 5, consisting of 100% by volume of a Xe gas, the discharge gas showed a brightness of 2.93 ($lm/m^2$), which is approximately ⅛ of the data in Comparative Example. Therefore, the contrast in the image display of the plasma display device can be maintained in an excellent state.

Further, as shown in the chromaticity diagram in FIG. 10, the color of emitted light in Comparative Example is orange, and this is caused by the main light emission of a Ne gas which emits light in orange. In Example 5, the color of emitted light is close to blue, and it is seen that the influence of the discharge gas in Example 5 on the color tone in image display of the plasma display device is smaller than the counterpart in Comparative Example.

The results of the above Examples 1 to 5 are summarized as follows.

(1) With an increase in the partial pressure of the first gas, the brightness increases, and when the partial pressure of the first gas is particularly $4\times10^3$ Pa or higher, a high brightness can be attained.

(2) When the concentration of the first gas is at least 10% by volume, particularly, at least 30% by volume, the brightness increases. The partial pressure of the first gas is required to be at least $1\times10^3$ Pa or higher.

(3) When the total gas pressure is less than $6.6\times10^4$ Pa, the discharge sustain voltage can be retained at a low level sufficient for driving.

(4) When the discharge gas is selected from a xenon (Xe) gas alone, a krypton (Kr) gas alone or a mixture of these, the brightness can be further improved.

(5) With a decrease in the distance between a pair of the sustain electrodes, the brightness tends to increase. Particularly, when the distance between a pair of the sustain electrodes is less than $5\times10^{-5}$ m particularly equal to, or less than, $2\times10^{-5}$ m, and when the concentration of the first gas is at least 10% by volume, particularly at least 30% by volume, the brightness remarkably increases.

While the present invention has been explained on the basis of preferred embodiments hereinabove, the present invention shall not be limited thereto. The structures or constitutions of the plasma display device explained in Examples and the materials, dimensions and production methods employed in Examples are all for illustrative purposes and can be modified or altered as required. The present invention can be applied to a transmission type plasma display device which permits observation of light emission of the fluorescence layers through the second substrate. In Examples, plasma display devices are constituted of a pair of the sustain electrodes extending in parallel with each other. Instead of such a constitution, there may be employed a constitution in which a pair of the bus electrodes extend in a first direction, one sustain electrode between a pair of the sustain electrodes extends in a second direction from one bus electrode between a pair of the bus electrodes toward and near the other bus electrode between a pair of the bus electrodes, and the other sustain electrode between a pair of the sustain electrodes extends in the second direction from the other bus electrode between a pair of the bus electrodes toward and near the one bus electrode between a pair of the bus electrodes. There may be employed a constitution in which one sustain electrode between a pair of the sustain electrodes extending in the first direction is formed on the first substrate and the other sustain electrode between a pair of the sustain electrodes is formed on an upper portion of the side wall of the separation wall in parallel with the address electrode. Further, the plasma display device of the present invention may be a bi-electrode type plasma display device. Furthermore, the address electrode can be formed on the first substrate. The thus-structured plasma display device can be constituted, for example, of a pair of the sustain electrodes extending in a first direction and an address electrode along one sustain electrode between a pair of the sustain electrodes in the vicinity of the one sustain electrode between a pair of the sustain electrodes (provided that the length of the address electrode along one sustain electrode between a pair of the sustain electrodes is equal to, or smaller than, the length of a discharge cell along the first direction). In addition, there is employed a structure in which a wiring for the address electrode which wiring extends in a second direction is formed through an insulating layer for preventing the short-circuiting thereof to the sustain electrodes, the wiring for the address electrode and the address electrode are electrically connected to each other, or the address electrode extends from the wiring for the address electrode.

Figure 11A:
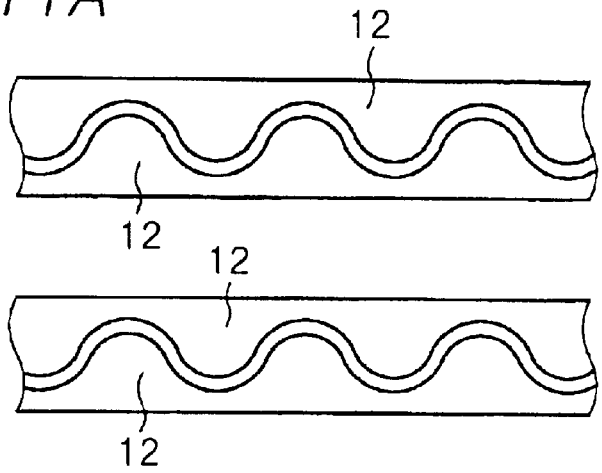
FIGS. 11A, 11B and 11C are schematic partial plan views of two sets of a pair of sustain electrodes when the gap formed by edge portions of a pair of the facing sustain electrodes has the form of a pattern bent or curved in the width direction of the sustain electrodes.
Figure 11B:
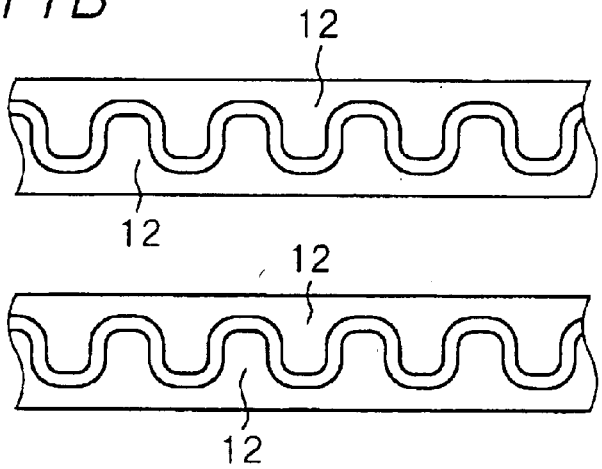
Figure 11C:
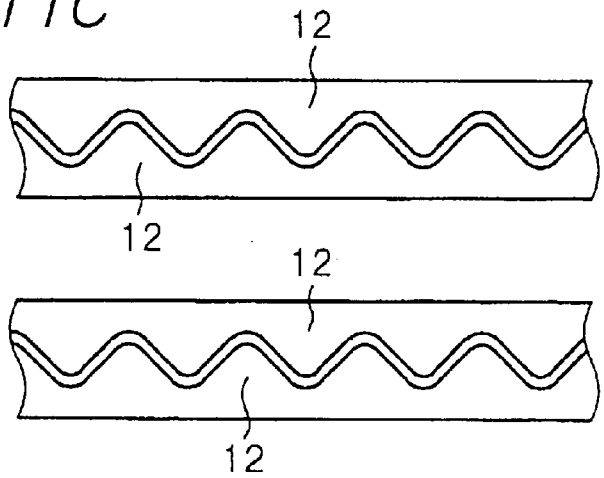

In Examples, the gap formed by the edge portions of a pair of the facing sustain electrodes has the form of a straight line. However, the gap formed by the edge portions of a pair of the facing sustain electrodes may have the form of a pattern bent or curved in the width direction of the sustain electrodes (for example, a combination of any forms such as the forms of a "dogleg", "S-letter" or arc). In such a constitution, the length of each of facing edge portions of a pair of the facing sustain electrodes can be increased, so that the discharge efficiency can be expected to improve. FIGS. 11A, 11B and 11C show schematic partial plan views of two sets of a pair of sustain electrodes having the above structures.

Alternatively, the plasma display device can be operated in the following AC glow discharge. First, erasing discharge is carried out with regard to all the pixels for initializing all the pixels. Then, discharge operation is carried out. The discharge operation is divided into an address period for which a wall charge is generated in the surface of the dielectric material layer by an initial discharge and a discharge sustain period for which the glow discharge is sustained. In the address period, a pulse voltage lower than the discharge initiating voltage $V_{bd}$ is applied to selected one sustain electrode between a pair of the sustain electrodes and to a selected address electrode. A region where the pulse-applied one sustain electrode between a pair of the sustain electrodes and the pulse-applied address electrode overlap is selected as a display pixel, and in the overlap region, the wall cahrge is generated in the surface of the dielectric material layer due to dielectric polarization, whereby the wall charge is accumulated. In the succeeding discharge sustain period, a discharge sustain voltage $V_{sus}$ lower than $V_{bd}$ is applied to a pair of the sustain electrodes. When the sum of the wall voltage $V_W$ induced by the wall charge and the discharge sustain voltage $V_{sus}$ comes to be greater than the discharge initiating voltage $V_{bd}$, (i.e., $V_W+V_{sus}>V_{bd}$), glow discharge is initiated. The phases of the discharge sustain voltages $V_{sus}$ applied to one sustain electrode between a pair of the sustain electrodes and the phase of the discharge sustain voltage $V_{sus}$ applied to the other sustain electrode between a pair of the sustain electrodes deviate from each other by half a cycle, and the polarity of each electrode is reversed according to the frequency of alternate current.

In the alternating current driven type plasma display devices according to the first to third aspects of the present invention, since the discharge gas consists of a xenon (Xe) gas alone or a krypton (Kr) gas alone, or the discharge gas consists of a mixed gas of a xenon (Xe) gas and a krypton (Kr) gas, a high brightness can be achieved, the discharge voltage can be decreased, the total pressure of the discharge gas can be decreased, and the reliability of the alternating current driven type plasma display device can be improved. Otherwise, in the alternating current driven type plasma display devices according to the fourth and fifth aspects of the present invention, since the discharge gas consists of a mixed gas and the partial pressure and the concentration of the first gas or a xenon gas which mainly contributes to discharging are defined, a high brightness can be achieved and the discharge voltage can be decreased. The concentration of the first gas or the xenon gas is increased, in other words, the concentration of the second gas or the other gas is decreased, and when the partial pressure of the first gas or the xenon gas is constant, the total pressure of the discharge gas can be decreased, so that the reliability of the alternating current driven type plasma display device can be improved. Further, since the discharge voltage can be decreased, a load on a driving circuit of the alternating current driven type plasma display device can be decreased, and further, the discharge is improved in stability.

What is claimed is:

1. An alternating current driven type plasma display device comprising a plurality of pairs of sustain electrodes, wherein discharge takes place between each pair of sustain electrodes, and a distance between a pair of sustain electrodes is less than $5\times10^{-5}$ m, and wherein a discharge gas charged in a discharge space where discharge takes place consists of a xenon gas alone and the discharge gas has a pressure greater than or egual to $1.0\times10^{4}$ Pa and less than or equal to $3.0\times10^{4}$ Pa.

2. An alternating current driven type plasma display device comprising a plurality of pairs of sustain electrodes, wherein discharge takes place between each pair of sustain electrodes, and a distance between a pair of sustain electrodes is less than $5\times10^{-5}$ m, and wherein a discharge gas charged in a discharge space where discharge takes place consists of a krypton gas alone and the discharge gas has a pressure less than equal to $6.6\times10^{4}$ Pa.

3. In an alternating current driven type plasma display device including a first panel and a second panel, wherein said first panel comprises a substrate, sustain electrodes formed on the substrate, and a dielectric film formed of at least a silicon oxide layer and on both the substrate and the sustain electrodes, and said first panel and the second panel being sealed at a periphery thereof, wherein a discharge gas charged in a discharge space where discharge takes place consists of a xenon gas alone and the discharge gas has a pressure greater than or equal to $1.0\times10^{4}$ Pa and less than or equal to $3.0\times10^{4}$ Pa, and wherein said sustain electrodes comprises a plurality of pairs of sustain electrodes, wherein discharge takes place between each pair of sustain electrodes, and a distance between a pair of sustain electrodes is less than $5\times10^{31\ 5}$ m.

4. In an alternating current driven type plasma display device including a first panel and a second panel, wherein said first panel comprises a substrate, sustain electrodes formed on the substrate, and a dielectric film formed of at least a silicon oxide layer and on both the substrate and the sustain electrodes, and said first panel and the second panel being sealed at a periphery thereof, wherein a discharge gas charged in a discharge space where discharge takes place consists of a krypton gas alone and the discharge gas has a pressure less than or equal to $6.6\times10^{4}$ Pa, and wherein said sustain electrodes comprises a plurality of pairs of sustain electrodes, wherein discharge takes place between each pair of sustain electrodes, and a distance between a pair of sustain electrodes is less than $5\times10^{-5}$ m.

* * * * *